US005584313A

United States Patent [19]

Britt

[11] Patent Number: 5,584,313

[45] Date of Patent: Dec. 17, 1996

[54] PISTON PRESSURE-TYPE VACUUM BREAKER

[75] Inventor: Gregory L. Britt, Matthews, N.C.

[73] Assignee: Conbraco Industries, Inc., Matthews, N.C.

[21] Appl. No.: 566,055

[22] Filed: Dec. 1, 1995

[51] Int. Cl.[6] ..... F16K 24/00; E03C 1/10

[52] U.S. Cl. ..... 137/218; 137/107

[58] Field of Search ..... 137/107, 218

[56] References Cited

U.S. PATENT DOCUMENTS

| | | | |
|---|---|---|---|
| 3,498,056 | 3/1970 | Avery | 137/107 X |
| 4,508,137 | 4/1985 | Bolgert | 137/218 |
| 5,125,429 | 6/1992 | Ackroyd et al. . | |

*Primary Examiner*—Gerald A. Michalsky
*Attorney, Agent, or Firm*—Shefte, Pinckney & Sawyer

[57] ABSTRACT

A valve for use in a fluid flow line comprises a housing having a piston chamber with a inlet, outlet, and a vent. An annular outer piston defining a central fluid flow opening is disposed in slidable sealing contact with the housing within the chamber. An inner piston extends axially through the central opening of the outer piston for relative axial movement and is movable in an axial direction between a first position, in which the inner piston blocks the inlet from the chamber, and a second position, in which the inner piston seals the vent from fluid communication with the chamber. The inner and outer pistons, furthermore, are movable relative to each other between an engaged condition, in which the outer piston engages the inner piston to seal the central opening thereof, and a disengaged condition, in which the central opening of the outer piston is open to fluid flow therethrough. A first resilient spring urges the inner and outer pistons into the engaged condition for blocking fluid communication of the inlet with both the outlet and the vent and yields to a first predetermined fluid pressure for forcing the inner and outer pistons into the disengaged condition. A second resilient spring urges the inner piston into the first position and yields to a second predetermined fluid pressure in the inlet for displacing the inner piston into the second position. Preferably, the second predetermined fluid pressure is less than the first predetermined fluid pressure.

12 Claims, 3 Drawing Sheets

PISTON PRESSURE-TYPE VACUUM BREAKER

BACKGROUND OF THE INVENTION

The present invention relates to the field of pressure-type vacuum breaker valves.

In a system of fluid piping, in the event of a reduction or reversal of supply pressure, a pressure-type vacuum breaker valve is designed to prevent the backward siphoning of water or other fluid from an outlet towards the inlet or supply source by "breaking" or relieving the vacuum caused by the pressure decrease. In a typical vacuum breaker, a valve controls the flow of fluid through a vent for discharging fluid in the outlet if fluid pressure in the outlet exceeds atmospheric pressure. Typically, such pressure-type vacuum breakers are used to provide protection between a contaminant source and a water supply. An example of a modern piston pressure-type vacuum breaker is disclosed, for example, by U.S. Pat. No. 5,125,429 to Ackroyd et al.

SUMMARY OF THE INVENTION

According to the present invention, a pressure-type vacuum breaker for use in a fluid flow line comprises a housing having a piston chamber with first, second, and third openings that communicate with the chamber. A piston assembly is disposed within the chamber and comprises an annular outer piston. The outer annular piston further defines a central fluid flow opening. The outer piston is in slidable sealing contact with the housing annularly within the chamber. The piston assembly also comprises an inner piston that extends axially through the central opening of the outer piston for relative axial movement with respect to the outer piston. Furthermore, the inner piston is movable in an axial direction between a first position and a second position with respect to the housing.

The inner piston is elongate and has first and second end portions. When the inner piston moves axially into the first position, the first end portion abuts against the housing thereby preventing further axial movement in that direction. Furthermore, the first end portion remains in abutment with the housing while the inner piston remains in the first position. When the inner piston moves into the second position, the second end portion blocks fluid flow to the second opening from the chamber. Specifically, the second end portion forms a first valve portion, wherein the first valve portion forms a seal with the housing for blocking fluid communication between the second opening and the chamber when the inner piston moves into and remains in the second position.

In one embodiment of the present invention, the first end portion forms a conical portion for blocking the first opening when the inner piston moves into and remains in the first position. In a feature of this embodiment, the conical portion forms a second valve portion, wherein the second valve portion forms a seal with the housing for blocking fluid communication between the chamber and the first opening when the inner piston moves into and remains in the first position.

Another feature of the present invention includes the inner and outer pistons being movably disposed relative to each other between an engaged condition, in which the outer piston engages the inner piston to form a seal and block fluid flow through the central opening of the outer piston, and a disengaged condition, in which the central opening of the outer piston is open to fluid flow therethrough. When the inner and outer pistons are in the engaged condition, the seal between the inner and outer pistons together with the seal between the outer piston and housing block fluid communication between opposite ends of the chamber. Moreover, when in the engaged condition, the piston assembly blocks fluid communication between the first opening and the second and third openings.

The present invention also comprises a first resilient means that is interposed between the inner piston and the outer piston for urging the inner and outer pistons into the sealingly engaged condition for blocking fluid communication of said first opening with said second and third openings. Furthermore, the first resilient means yields to a first predetermined fluid pressure in the first opening for forcing the inner and outer pistons into the disengaged condition.

A further feature of the present invention includes a second resilient means interposed between the inner piston and the housing for urging the inner piston into the first position. Furthermore, the second resilient means yields to a second predetermined fluid pressure for displacing the inner piston into the second position. Preferably, the second predetermined fluid pressure is less than the first predetermined fluid pressure. Also, each resilient means preferably comprises a spring.

DETAILED DESCRIPTION OF THE PREFERRED EMBODIMENT

Figure 1:
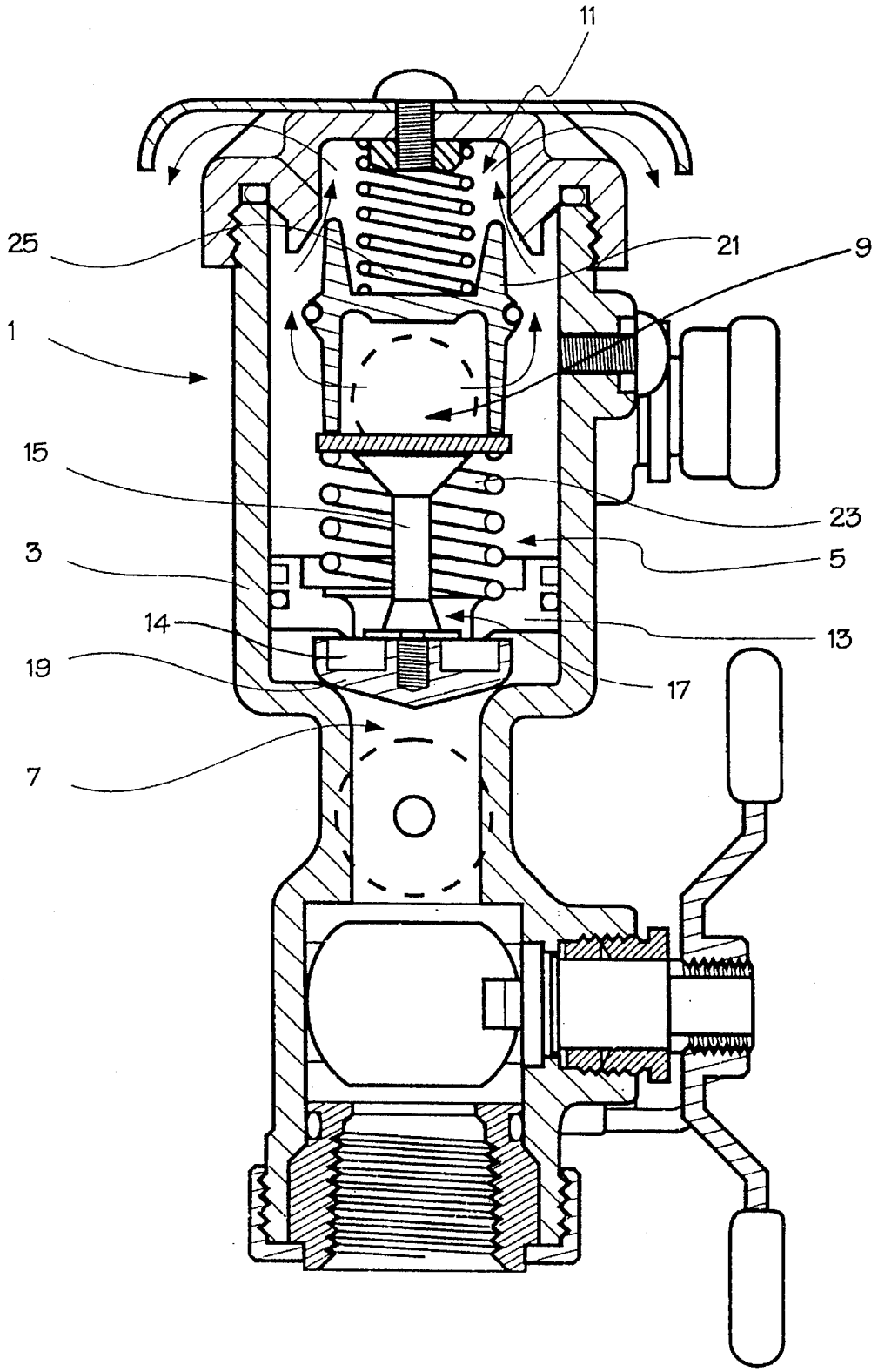
FIG. 1 is a side cut-away view of the preferred embodiment of the pressure-type vacuum breaker valve of the present invention in a closed, venting position.

Referring now to the drawings, the preferred embodiment of the present invention will be described in detail.

The preferred piston pressure-type vacuum breaker, or valve 1, of the present invention is generally indicated in FIG. 1. The valve comprises; a housing 3 having a piston chamber 5 with three openings: an inlet 7, and outlet 9, and a vent 11. A piston assembly is disposed within chamber 5 and comprises an annular outer piston 13 and an inner piston 15. The outer piston 13 defines a central fluid flow opening 17 and is in slidable sealing disposition with housing 3 annularly about chamber 5. The inner piston 15 extends axially through central opening 17 in outer piston 13 for relative axial movement therethrough between a first and second position.

In the preferred embodiment, the first end portion of inner piston 15 forms a conical portion 19. When inner piston 15 moves into and remains in the first position, as shown in FIG. 1, conical portion 19 abuts against housing 3 and prevents further axial movement of inner piston 15 away from vent 11. Furthermore, conical portion 19 blocks inlet 7 from chamber 5. It is possible to construct conical portion 19 to form a valve portion and thereby provide a seal between conical portion 19 and housing 3 to block fluid communication between inlet 7 and chamber 5; however, it is not a necessary feature of the preferred embodiment of the invention that conical portion 19 form a seal blocking fluid communication between inlet 7 and chamber 5. Rather, the essential function of conical portion 19 in the preferred embodiment is to prevent further axial movement of inner piston 15 away from vent 11.

Figure 2:
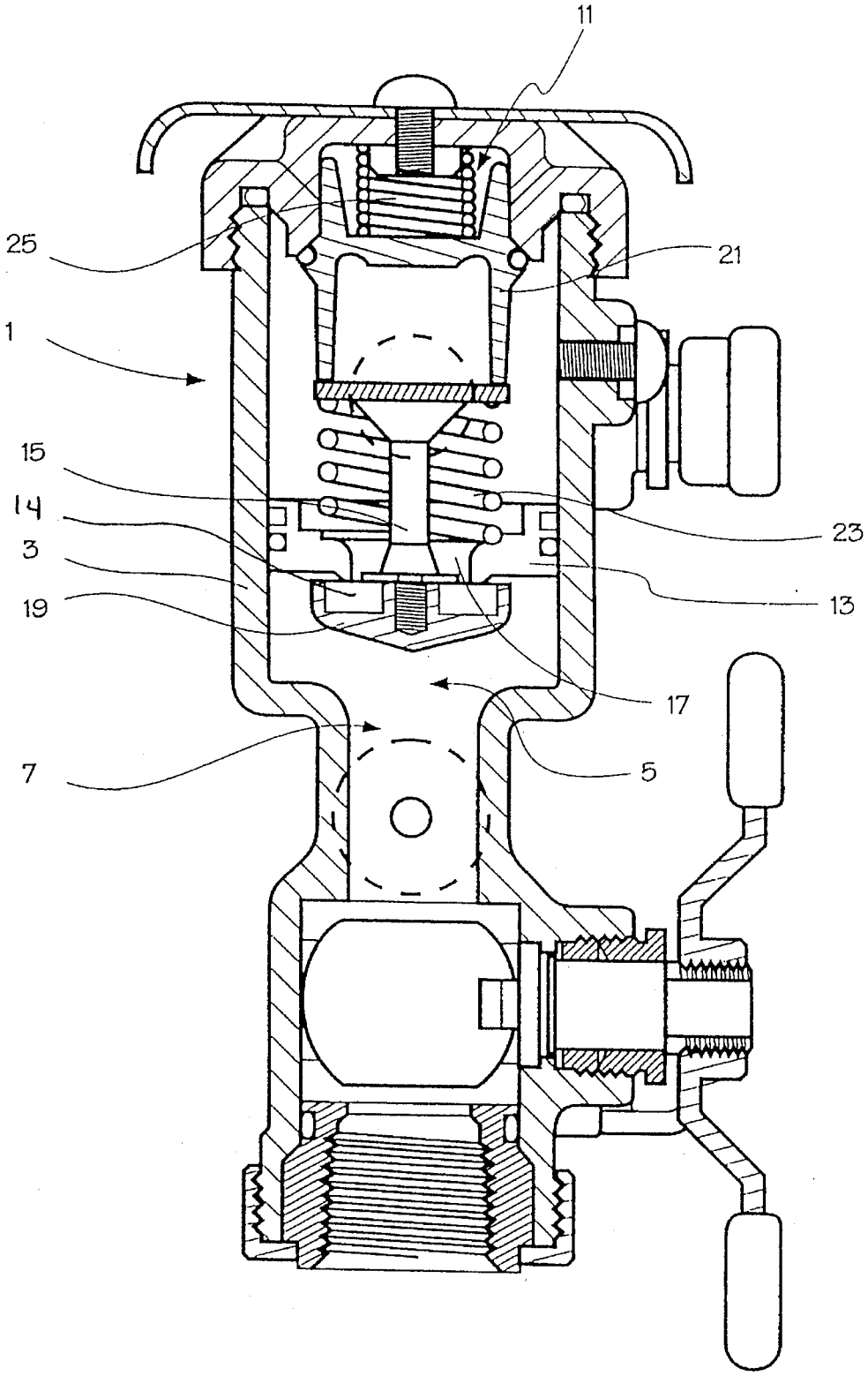
FIG. 2 is a side cut-away view of the valve of FIG. 1 in the intermediate position.

When inner piston 15 moves into and remains in the second position, the second end portion of inner piston 15 which forms valve portion 21 blocks fluid flow to vent 11 from chamber 5, as shown in FIG. 2. Specifically, valve portion 21 forms a seal with housing 3 for blocking fluid communication between vent 11 and chamber 5.

Figure 3:
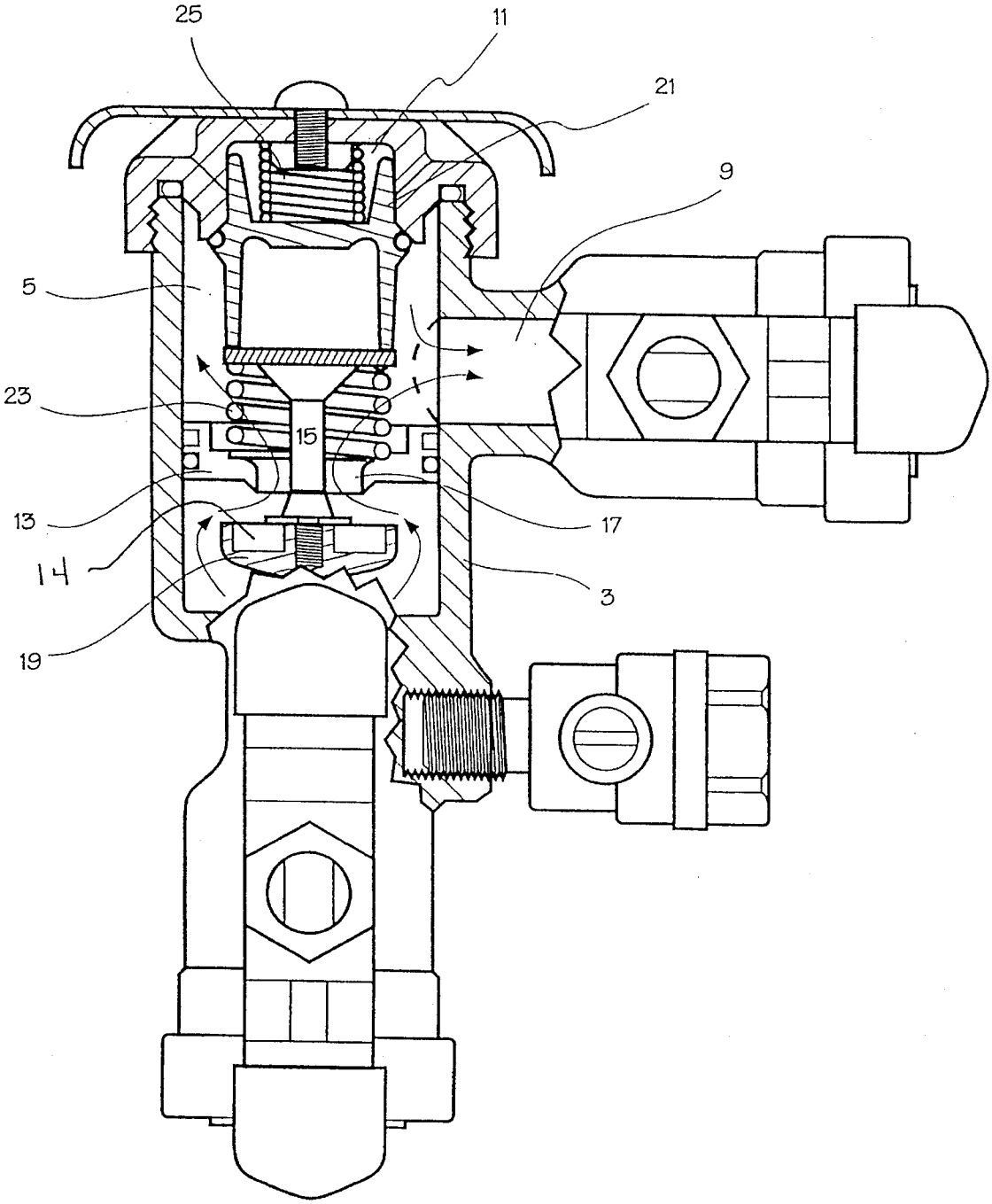
FIG. 3 is a side cut-away view of the valve of FIG. 1 in the open flow position.

Furthermore, in the preferred embodiment, the inner and outer pistons are movable relative to each other between an engaged condition, shown in FIGS. 1 and 2, and a disengaged condition, shown in FIG. 3. In the engaged condition, outer piston 13 engages inner piston 15 to close central opening 17, thereby blocking fluid communication of inlet 7 with outlet 9 and vent 11. Specifically, as shown in FIG. 1, outer piston 13 engages in sealing engagement annular ring 14, which preferably is formed from rubber. In the disengaged condition, outer piston 13 and inner piston 15 are disengaged from one another to allow fluid flow through central opening 17, as illustrated by flow arrows in FIG. 3.

The valve of the present invention also includes a first resilient means, or first spring 23, interposed between inner piston 15 and the outer piston 13 for urging inner and outer pistons 13, 15 into the engaged condition, as shown in FIGS. 1 and 2, thereby blocking fluid communication between inlet 7, outlet 9, and vent 11. Preferably, spring 23 has a spring constant and is pretensioned such that it will yield to a first predetermined fluid pressure in inlet 7 to force inner and outer pistons 13, 15 out of the engaged condition, as described hereinafter.

Also in the preferred embodiment of the present invention, valve 1 further comprises a second resilient means interposed between inner piston 15 and housing 3 for urging inner piston 15 into the first position for blocking inlet 7 from chamber 5. The second resilient means, preferably a second spring 25, also has a spring constant and is pretensioned such that it will yield to a second predetermined fluid pressure in inlet 7. Furthermore, the fluid pressure necessary to force inner piston 15 into the second position is preferably less than the first predetermined fluid pressure to which spring 23 yields.

The functioning of the valve of the preferred embodiment will now be described. Initially, the valve rests in a closed, venting position as shown in FIG. 1. In this figure, the fluid pressure in the inlet 7 is insufficient to force inner piston 15 against second spring 25, and therefore conical portion 19 remains in contact with housing 3 and blocks inlet 7. Furthermore, inner piston 15 is urged by second spring 25 towards inlet 7 and therefore valve portion 21 of inner piston 15 does not block vent 11. If fluid pressure in outlet 9 is greater than atmospheric pressure, then the fluid in outlet 9 will discharge through vent 11 as shown by flow arrows in FIG. 1.

Also when in the position of FIG. 1, while conical portion 19 blocks inlet 7, fluid may nevertheless leak into chamber 5 in the preferred embodiment. Since spring 23 urges outer piston 13 and inner piston 15 into the engaged condition, any such fluid in chamber 5 is nevertheless isolated from outlet 9 and vent 11. Pressure in this fluid, furthermore, cannot force outer piston 13 and inner piston 15 out of the engaged condition, since the fluid pressure in inlet 7 is insufficient to compress spring 25, which requires less force than spring 23 to compress.

When the fluid pressure in inlet 7 becomes sufficient to overcome second spring 25, the fluid forces inner piston 15 out of blocking engagement with inlet 7. Inner piston 15 and outer piston 13 nevertheless continue to block fluid communication of inlet 7 with outlet 9 and vent 11, thereby continuing to maintain the barrier to fluid flow.

At this point the relative compression of springs 23,25 becomes important. Preferably, the force required to disengaged outer piston 13 from inner piston 15 is greater than the force require to move valve portion 21 into blocking engagement with vent 11, as shown in FIG. 2. If this is true, then inner piston 15 and outer piston 13 will remain in the engaged condition until fluid pressure in inlet 7 is sufficient to force valve portion 21 into vent 11 to block fluid communication between vent 11 and chamber 5.

On the other hand, if the force required to disengage outer piston 13 from inner piston 15 is less than the force required to move valve portion 21 into blocking engagement with vent 11, then outer piston 13 will disengage from inner piston 15 and permit fluid flow from inlet 7 to outlet 9 and vent 11. In this case, the fluid from the inlet 7 will mix and combine with other fluid in the outlet or vent, and will flow either through outlet 9 or vent 11, or both, depending upon the relative pressures of the fluids in the outlet 9 and vent 11. This is not the preferable mode of operation of the valve of the present invention.

Returning to the preferred embodiment, in which spring 25 yields and fully compresses before spring 23 yields, sufficient fluid pressure in inlet 7 will first force inner piston 15 towards second spring 25, compressing it and blocking communication of vent 11 from chamber 5 by valve portion 21. If further sufficient, the, fluid pressure in inlet 7 will then force outer piston 13 out of engagement with inner piston 15, thereby permitting fluid in inlet 7 and the lower part of piston chamber 5 access to outlet 9 only, as shown by fluid flow arrows in FIG. 3.

If for whatever reason fluid pressure drops in inlet 7, then the first part of valve 1 to react as herein preferably described will be spring 23 and outer piston 13. The loss of pressure fluid in inlet 7 and in the lower part of chamber 5 will allow first spring 23 to once again urge outer piston 13 into the engaged condition with inner piston 15, blocking further fluid flow from inlet 7 to outlet 9. Furthermore, if the pressure drop is sufficient, second spring 25 will once again urge inner piston 15 towards inlet 7, thereby causing conical portion 19 to once again block inlet 7 and also thereby open vent 11 by disengaging valve portion 21 from vent 11. This allows any back flow from outlet 9 during a sufficient pressure drop to exit the valve through vent 11 rather than reenter and flow through inlet 7 towards the fluid source.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A valve for controlling a fluid flow, comprising:

(a) a housing having a piston chamber having a first, second, and third opening in said housing communicating with said chamber, (b) a piston assembly disposed within said chamber and comprising an annular outer piston defining a central fluid flow opening, said outer piston being in slidable sealing disposition with said housing annularly within said chamber, and an inner piston extending axially through said central opening in said outer piston for relative axial movement with respect thereto, said inner piston being movable with respect to said housing in an axial direction between a first position in which said inner piston abuts against said housing, thereby preventing further axial movement, and a second position opposite said first position in which said inner piston abuts against said housing and blocks said second opening from fluid communication with said chamber, said inner and outer pistons being relatively movable between an engaged condition in which said outer piston engages said inner piston forming a fluid seal to block fluid flow through said central opening, thereby blocking fluid communication of said first opening with said second and said third openings, and a disengaged condition in which said central opening of said outer piston is open to fluid flow therethrough, and (c) resilient means interposed between said inner piston and said outer piston, said resilient means being the sole means for urging said inner and outer pistons into said engaged condition, said resilient means being yieldable to a predetermined fluid pressure for forcing said inner and outer pistons into said disengaged condition.

2. A valve according to claim 1 wherein said inner piston when in said first position abuts against said housing and blocks said first opening.

3. A valve according to claim 2, said inner piston further comprising a valve portion that blocks fluid communication between said second opening and said chamber when said inner piston is in said second position.

4. A valve according to claim 2 wherein said inner piston comprises a conical portion that blocks said first opening when said inner piston is in said first position.

5. A valve according to claim 4 wherein said conical portion forms a seal with said housing thereby blocking fluid communication between said first opening and said chamber when said inner piston is in said first position.

6. A valve according to claim 2, said inner piston further comprising a first valve portion which blocks fluid flow between said second opening and said chamber when said inner piston is in said second position, and a second valve portion which blocks fluid flow between said first opening and said chamber when said inner piston is in said first position.

7. A valve for controlling a fluid flow, comprising:

(a) a housing having a piston chamber having a first, second, and third opening in said housing communicating with said chamber, (b) a piston assembly disposed within said chamber and comprising an annular outer piston defining a central fluid flow opening, said outer piston being in slidable sealing disposition with said housing annularly within said chamber, and an inner piston extending axially through said central opening in said outer piston for relative axial movement with respect thereto, said inner piston being movable with respect to said housing in an axial direction between a first position in which said inner piston abuts against said housing, thereby preventing further axial movement, and a second position opposite said first position in which said inner piston abuts against said housing and blocks said second opening from fluid communication with said chamber, said inner and outer pistons being relatively movable between engaged condition in which said outer piston engages said inner piston forming a fluid seal to block fluid flow through said central opening, thereby blocking fluid communication of said first opening with said second and said third openings, and a disengaged condition in which said central opening of said outer piston is open to fluid flow therethrough, (c) a first resilient means for urging said inner and outer pistons into said engaged condition interposed between inner piston and said outer piston, said first resilient means being yieldable to a first predetermined fluid pressure for forcing said inner and outer pistons into said disengaged condition, and (d) a second resilient means interposed between said inner piston and said housing for urging said inner piston into said first position, said second resilient means being yieldable to a second predetermined fluid pressure to displace said inner piston into said second position.

8. A valve according to claim 7, wherein said second predetermined fluid pressure is less than said first predetermined fluid pressure.

9. A valve according to claim 8, wherein said first and said second resilient urging means comprise springs.

10. A valve for controlling a fluid flow according to claim 8, wherein said first resilient means is yieldable to said first predetermined fluid pressure independently of said second resilient means.

11. A valve according to claim 7, wherein said first resilient means and said second resilient means are disposed in axially spaced relation to one another.

12. A valve for controlling a fluid flow, comprising:

(a) a housing having a piston chamber having a first, second, and third opening in said housing communicating with said chamber, (b) a piston assembly disposed within said chamber and comprising an annular outer piston defining a central fluid flow opening, said outer piston being in slidable sealing disposition with said housing annularly within said chamber, and an inner piston extending axially through said central opening in said outer piston for relative axial movement with respect thereto, said inner piston having a conical portion and a valve portion and being movable with respect to said housing in an axial direction between a first position in which said conical portion abuts against said housing and blocks said first opening, thereby preventing further axial movement of said inner piston, and a second position opposite said first position in which said valve portion abuts against said housing and blocks said second opening from fluid communication with said chamber, said inner and outer pistons being relatively movable between an engaged condition in which said outer piston engages said inner piston thereby forming a fluid seal to block fluid flow through said central opening, thereby blocking fluid communication of said first opening with said second and said third openings, and a disengaged condition in which said central opening of said outer piston is open to fluid flow therethrough, (c) a first resilient means comprising a first spring interposed between said inner piston and said outer piston for urging said inner and outer pistons into said engaged condition, said first spring being yieldable to a first predetermined fluid pressure for forcing said inner and outer pistons into said disengaged condition, (d) and a second resilient means comprising a second spring interposed between said inner piston and said housing for urging said inner piston into said first position, said second spring being yieldable to a second predetermined fluid pressure to displace said inner piston into said second position, said second predetermined fluid pressure being less than said first predetermined fluid pressure.

* * * * *